United States Patent [19]

Hatch

[11] 4,036,115

[45] July 19, 1977

[54] SACK MAKING EQUIPMENT

[75] Inventor: Ronald Frank Hatch, Grays Point, Australia

[73] Assignee: St. Regis-Aci Pty. Limited, Botany, Australia

[21] Appl. No.: 599,511

[22] Filed: July 28, 1975

[30] Foreign Application Priority Data

Aug. 8, 1974 Australia ..... 8452/74

[51] Int. Cl.[2] ..... B31B 21/02

[52] U.S. Cl. ..... 93/8 R

[58] Field of Search ..... 93/8 R, 8 W, 8 WA, 21, 93/22, 26, 27, 14, 18; 198/19, 42; 271/273, 64, 173

[56] References Cited

U.S. PATENT DOCUMENTS

| | | | |
|---|---|---|---|
| 1,842,680 | 1/1932 | Litchfield | 93/27 |
| 1,926,421 | 9/1933 | Andreas | 93/27 X |
| 3,566,754 | 3/1971 | Stork et al. | 93/8 R |
| 3,580,141 | 5/1971 | Richter | 93/8 R |
| 3,871,270 | 3/1975 | Kuckhermann et al. | 93/8 R X |

*Primary Examiner*—James F. Coan

*Attorney, Agent, or Firm*—Ladas, Parry, Von Gehr, Goldsmith & Deschamps

[57] ABSTRACT

The present invention relates to bag making machines, a particular embodiment of which comprises a system of two-way gates, a tubing machine which forms a tube of suitable material, cuts the formed tube into tube lengths and axially discharges the tube lengths into the system of two-way gates, a plurality of sewing machines and associated feed conveyors, the system of gates directing the tube lengths in a cyclic sequence to the sewing machine feed conveyors which transfer the tube lengths sideways to the sewing machines. The operation timing of the sewing machines and associated feed conveyors and the system of two-way gates is controlled with respect to that of the tubing machine drive.

35 Claims, 4 Drawing Figures

SACK MAKING EQUIPMENT

The present invention relates to sack or container making equipment and more particularly, but not exclusively, to a machine for making sewn-end multi-walled sacks.

Conventionally multi-walled sewn-end paper sacks are produced by passing a number of plies of paper, for example, from 2 to 6 plies, through a tubing machine, which folds the paper to form a composite or multi-walled tube having a number of concentric tubes corresponding to the number of plies used. Each ply of paper is glued along the longitudinal seams prior to folding in the tubing machine and the plies of paper are folded in such a manner to substantially prevent adjacent tubes from adhering to each other. The composite tube is then cut into lengths.

Further, there are generally two basic types of multi-walled tube produced on a tubing machine, namely a flat type and a gussetted type. The gussetted type is provided with a gusset along each longitudinal side of the tube and this type of tube is more generally used in the manufacture of sewn-end sacks, the gusset forming a box type end when open for filling. Further a lesser amount of sewing is required, due to the narrower width of the tube.

The conventional tubing machine discharges a continuous supply of multi-walled tube lengths which are stacked in bundles by hand or machine stackers. The bundles are then placed by hand onto a pallet which is subsequently moved to a sewing machine into which the tubes are individually fed by hand. One end of each tube is then sealed by sewing, usually over a crepe paper tape.

There are a number of variations in means used to transfer tubes from the tubing machine to the sewing machines but, as the output from the tubing machine is substantially greater than the maximum capacity of the sewing machines, the tubes still have to be hand fed into the sewing machines.

Further, automatic feeding of gussetted sacks into the sewing machines by conventional means is an extremely difficult and costly operation. In one known sack or bag making machine, the cut tubes are discharged in an axial direction from the tubing machine and are then oriented through 90 degrees such that an open end of each tube is aligned in the direction of discharge from the tubing machine. The tubes, thus aligned, may then pass through a tube-end sealing-machine. With such a sack making machine, it is difficult and extremely costly to adjust the machine to suit size changes in sack widths and lengths. It should be noted that such conventional sack or bag making machines have not been adapted for use with a sewing machine to seal the bag ends.

It is an object of the present invention to provide a machine substantially free of the above disadvantages.

It is another object of the present invention to provide means of automatically transferring tubes discharged from a tubing machine to the sewing machines and thereby eliminating work in progress and considerably reducing labour costs.

Accordingly the present invention in one general form is a transfer machine comprising a receiving station for receiving a succession of tube lengths axially discharged from a tubing machine, a plurality of tube-end sealing-machine feeding stations, and means directing the tube lengths to said plurality of feeding stations.

The present invention in another general form is a transfer machine comprising a receiving station for receiving a succession of tube lengths, a plurality of sewing machine feeding stations, means directing the tube lengths in succession to said plurality of sewing machine feeding stations, each said feeding station including means permitting alignment of an end of each tube length with respect to the sewing machine and means permitting the continuous feeding fo the tube lengths into the sewing machine for sewing.

The present invention in yet another general form is a tube-end sealing-machine comprising a sealing head, a conveyor having a receiving end and a discharge end, the sealing head located adjacent said discharge end, a plurality of abutment means arranged at predetermined intervals along the length of the conveyor and movable from said receiving end to said discharge end, whereby, upon receipt at said receiving end of a succession of tube lengths, the tubular axis of which is in transverse alignment with respect to said conveyor, an adjacent one of said abutment means abuts a trailing side of each successive tube length and urges the tube length towards said discharge end of the conveyor, and bias means causing each tube length to move forward with respect to said adjacent one of said abutment means and abut at its leading side against a forward and adjacent one of said abutment means.

The present invention in a further general form is a bag making machine comprising a tubing machine which forms a tube of suitable material, cuts the formed tube into tube lengths and axially discharges the tube lengths therefrom, a plurality of tube-end sealing-machines each having in association therewith a tube feed conveyor, which, upon receipt of a succession of tube lengths each having their tubular axis in transverse alignment with respect to the feed direction, feeds an open end of each tube length to the tube-end sealing-machine, means receiving the axially aligned tube lengths discharged from said tubing machine and means directing and feeding successive tube lengths in a cyclic predetermined sequence to a receiving end of the tube feed conveyor, the feed direction of which is transverse to that of said means directing and feeding tube lengths to said receiving end, whereby axially discharged tube lengths having a leading and trailing open end are traversed sideways to provide a leading and trailing closed side edge.

In a preferred form, the abovementioned transfer machine allows multi-walled tube lengths to be transferred directly from the tubing machine to the sewing machines without manual handling irrespective of the tube length discharge rate from the tubing machine and without orientating the tube lengths following receipt thereof from the tubing machine. In the preferred form of the invention, the tube lengths initially flow in a direction substantially parallel to the longitudinal axis of the tube to their respective sewing machine feeding stations. The tube lengths are then each stopped for an instant at the feed station and redirected in a sideways direction. Preferably the sewing machines and transfer machine drives are directly coupled with the tubing machine in order to simplify timing and changes of speed of the various machines and operations.

A preferred embodiment of the present invention will now be described by way of example with reference to the accompanying drawings, wherein.

Figure 1:
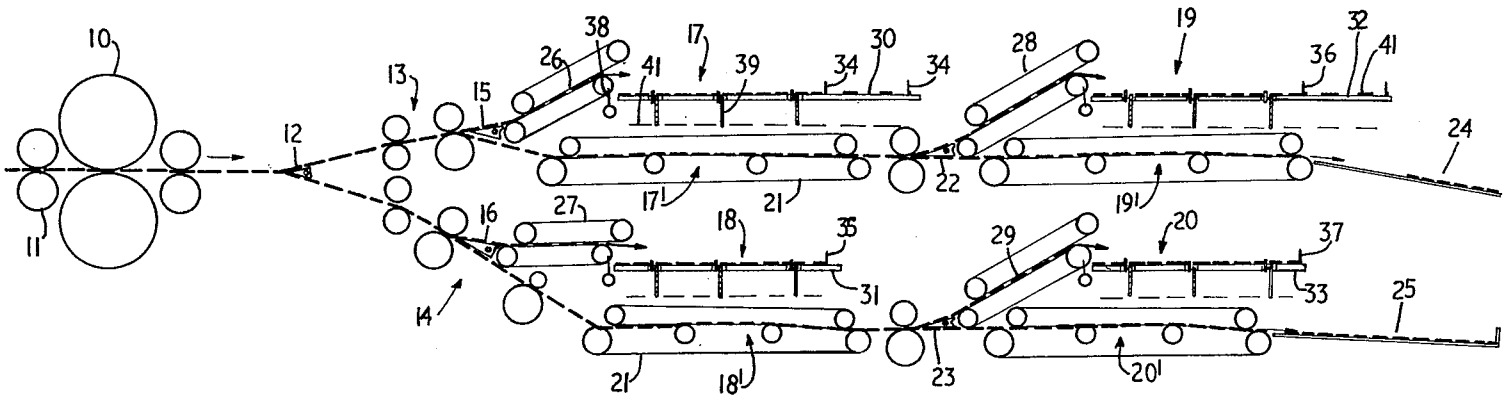
FIG. 1 is a side elevation of a transfer machine in schematic form for delivery of multi-walled paper sacks to four sewing stations.

Referring to FIG. 1, multi-walled or composite tubes are formed in a tubing machine in the conventional manner and cut on a cutting head 10, which, in the illustrated preferred embodiment, rotates at a predetermined and constant number of revolutions per minute. The cutting head 10 illustrated may be provided with two cutting edges on its circumference for cutting two tube lengths during every one revolution of the cutting head, however, any convenient number of cutting edges may be used as required. In order to vary the length of the cut tube within a range, the speed of drive rollers 11 may be adjusted with respect to the cutting head. If longer sacks are required then one cutting edge is removed and thus increasing the length of the tube which passes through the cutting head between each cutting operation of the head.

In operation with the tubing machine set-up with two cutting edges, i.e. known as a "2 up cut" to those skilled in the art, two tubes are discharged from the tubing machine for every revolution of the head. The flow of tube lengths is directed by conventional belt conveyors or any other suitable means to a two-way gate 12 which alternates between two positions. In one position the gate directs tube lengths to an upper belt transfer system 13 and in the other position to a lower belt transfer system 14. The gate speed is set to alternately direct successive tube lengths to the upper and lower transfer systems 13 and 14. These alternate tube lengths are then received by a pair of two-way gates 15 and 16, which also alternate between two positions to either direct tube lengths to sewing machine feeding stations 17 and 18 respectively or to feeding station by-passes 17′ and 18′ respectively.

Those tube lengths which are directed to by-passes 17′ and 18′ are transferred by belt conveyors 21 to a further two two-way gates 22 and 23 respectively, which, during normal operation with a "2 up cut", direct the flow of tube lengths in by-passes 17′ and 18′ to sewing machine feeding stations 19 and 20 respectively. Accordingly, during normal operation with a "2 up cut", the tube lengths discharged from the tubing machine may be directed in sequence to feeding stations 17, 18, 19 and 20, the gates 15, 16, 22 and 23 being time controlled with respect to the tubing machine cutting head 10.

When longer tube lengths are discharged from the tubing machine, i.e. during "1 up" operation, gate 12 is set to direct the flow of tube lengths to the upper transfer system 13 only and gate 15 subsequently distributes the flow alternately between stations 17 and 19.

If a malfunction occurs in a sewing machine or in a sewing machine feeding station, or threads or tape require changing or replenishing which may necessitate stopping a sewing machine; then its respective two-way gate 15, 16, 22 or 23 is operated to prevent that station from receiving any further tube lengths. The station may then be shut down for remedial action. However, it should be noted that an interlock is required to override shutting down of the sewing machine feed station and its respective two-way gate upon initiating station shutdown at an instant when the gate is in the process of receiving a tube length; namely, the gate should remain open until the tube length has passed through it before it operates to the feed station closed position. Also on restarting of the sewing machine feeding station an interlock is required to prevent the gate from operating to the feed station open position whilst a tube length is passing under the gate to the respective by-pass conveyor. The tube lengths normally destined for the shutdown station are conveyed, in the case of stations 19 and 20, by by-pass conveyors 19′ and 20′ to ends 24 and 25 respectively of the machine, where they may be stacked and stored for re-working at a later date. In a case where the malfunction occurs at either stations 17 or 18, the flow is directed along either by-pass 17′ or 18′ respectively. However, gates 22 or 23 respectively must now operate to direct the excess flow in by-passes 17′ or 18′ to the ends 24 or 25 of the machine.

Although downtime in production caused by maintaining sewing machines and tape cutters is generally relatively small, there are occasions when continuous production is of paramount importance. In these circumstances additional spare sewing machine feeding stations complete with sewing heads and cross-conveyors may be incorporated so that should one cross-conveyor or sewing station be stopped for any reason then tubes that would have been received at that station are directed to the spare station.

Figure 4:
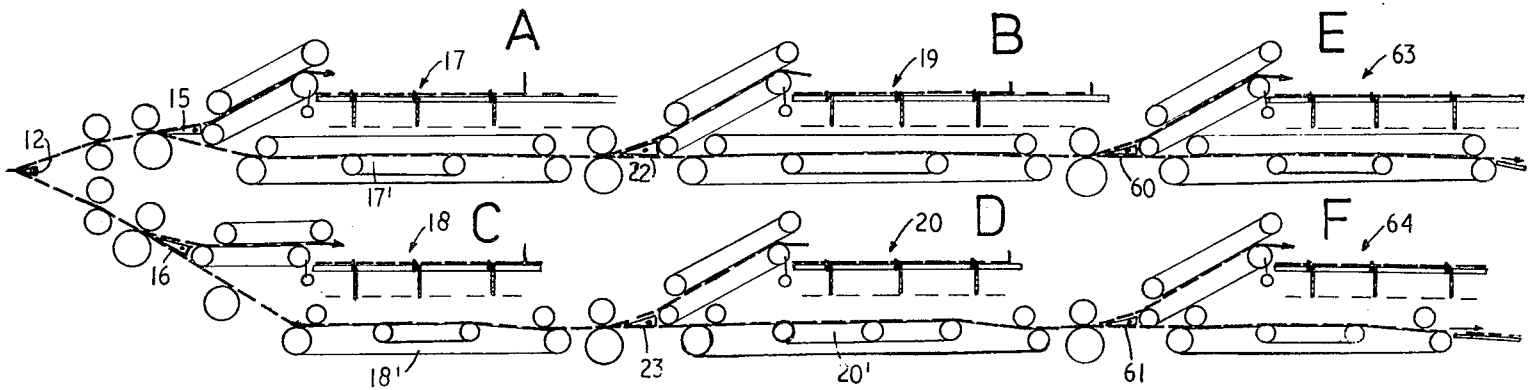
FIG. 4 is a side elevation of a transfer machine in schematic form for delivery of multi-walled paper sacks to six sewing stations.

Accordingly the transfer machine of FIG. 1 may be adapted to include two spare sewing machine feeding stations 63 and 64 as shown in FIG. 4. For convenience stations 17, 19, 18, 20, 63 and 64 are also designated A, B, C, D, E and F respectively, and those tubes directed to station A will be called A tubes and those for stations B, C and D will be called B, C and D tubes respectively. In the arrangement shown in FIG. 4, operated under normal conditions when, say, a "2 up cut" is used, the tubes are directed in a sequence to stations A, B, C and D. Now should either cross-conveyor sewing station A or B be stopped, then A or B tubes destined for those stations may be directed to cross-conveyor sewing station E, likewise should either cross-conveyor sewing stations C or D be stopped then C or D tubes may be directed to cross-conveyor sewing station F.

For control and timing purposes it should be noted that all drives are coupled either mechanically or electrically to the tubing machine drive and hence to the tubing machine cutting head. Accordingly in the arrangement shown in FIG. 4, the cross-conveyor sewing stations E and F are each provided with a two position coupling mechanism which engages with the tubing machine drive. In the case of station E, in one position the station may receive A tubes and in the other position the station may receive B tubes.

The timing of the cross-conveyor sewing station E and gate 60 is coupled so that the timing of the complete unit can be adjusted to suit receipt of A tubes or B tubes, and similarly station F may be adjusted to receive C or D tubes as required.

Taking for example the case where it is necessary to stop cross-conveyor sewing station A, the drive of station A is disengaged and the A tube timing drive on cross-conveyor sewing station E is selected and engaged. When station A is stopped gate 15 closes and all A tubes are directed along conveyor 17′ past gate 22 which is timed not to receive A tubes but only B tubes and then along conveyor 19' to gate 60 which will now operate to direct A tubes to station E.

Returning now to the arrangement shown in FIG. 1, the tube lengths are fed into the sewing machine feeding stations 17, 18, 19 and 20 by a series of belts and gates in the manner described above. The tube lengths are discharged out of belt conveyors 26, 27, 28 and 29 respectively onto tables 30, 31, 32 and 33 to abut against adjustable end stops 34, 35, 36 and 37 respectively. The four feeding stations illustrated in FIG. 1 are substantially identical with the exception that tables 30 and 32 of stations 17 and 19 are wider than that of stations 18 and 20 in order to accommodate longer tube lengths during "1 up" operation of the cutting head 10. For simplification of disclosure only station 17 will be described in detail.

For "2 up" operation as generally illustrated in FIG. 1, the end stop 34 is set to suit a predetermined tube length received by the feeding station. A series of fingers 38, as shown at station 17, act on the tube length to locate any malpositioned tube lengths, which are discharged from conveyor 26 onto the table 30 at the receiving end of a cross-conveyor 50. The cross-conveyor is provided with driving fingers or pins 40 attached to chains 39 or the like, which pins push the tube lengths sideways off the feeding table 30 onto belts 41 for delivery to the sewing machine 43. The tube lengths are identified in FIG. 2 by numeral 42. The belts 41 travel faster than the chains 39 and cause the tube lengths 42 fed off the table 30 to move forward and abut against an adjacent set of driving pins 40. As a result of the tube lengths being located with their forward edge against pins 40, timing of the position of the tube lengths with respect to the sewing machine, is greatly simplified. If the pins were to abut against the rearward edge of each tube length to push the tube length to the sewing machine, the pins would have to be so designed that they could be removed from the tube pushing position when the tube is entering the sewing machine, as the pins would normally be travelling faster than the feed speed of the tube lengths through the sewing head of the sewing machine, such a mechanism would require adjustment for every different tube width of bag manufactured. Such adjustment of pins 40 is particularly undesirable as it extends machine downtime between bag runs of different sizes.

It will be noted that the sewing machine 43 is positioned to sew the trailing edge 44 of the tube lengths, with respect to their direction of motion during discharge from conveyor 26 onto table 30. When a tubing machine having a substantially constant speed cutting head, is used, such as that described herein with reference to FIG. 1, the timing of gates 15, 22, 16 and 23 and cross-conveyor pins 40 are all timed in relationship to the trailing edge of the tube length as the relative position of the trailing edge during transfer to the cross-conveyor feeding station is substantially fixed for any length of tube cut on the tubing machine. Consequently timing of the cross-conveyor feeding station is not affected by varying tube lengths.

Further, if the sewing machine was arranged to sew the leading edge 45, end stop 34 would be located in fixed relationship to the sewing machine and at a position to suit the maximum capacity of the machine. Accordingly an additional conveyor would be required to transfer all tube lengths smaller than the maximum permissible in the machine to a position abutting against the end stop, which acts as a reference point for alignment of the tube lengths with the sewing head of the sewing machine. Therefore, it is preferable to provide an adjustable end stop which may be set to suit the tube length passing through the machine, as opposed to providing additional conveyors. Also it will be noted that such end stops minimises the adjustment required to handle varying widths and lengths of tubes.

Figure 2:
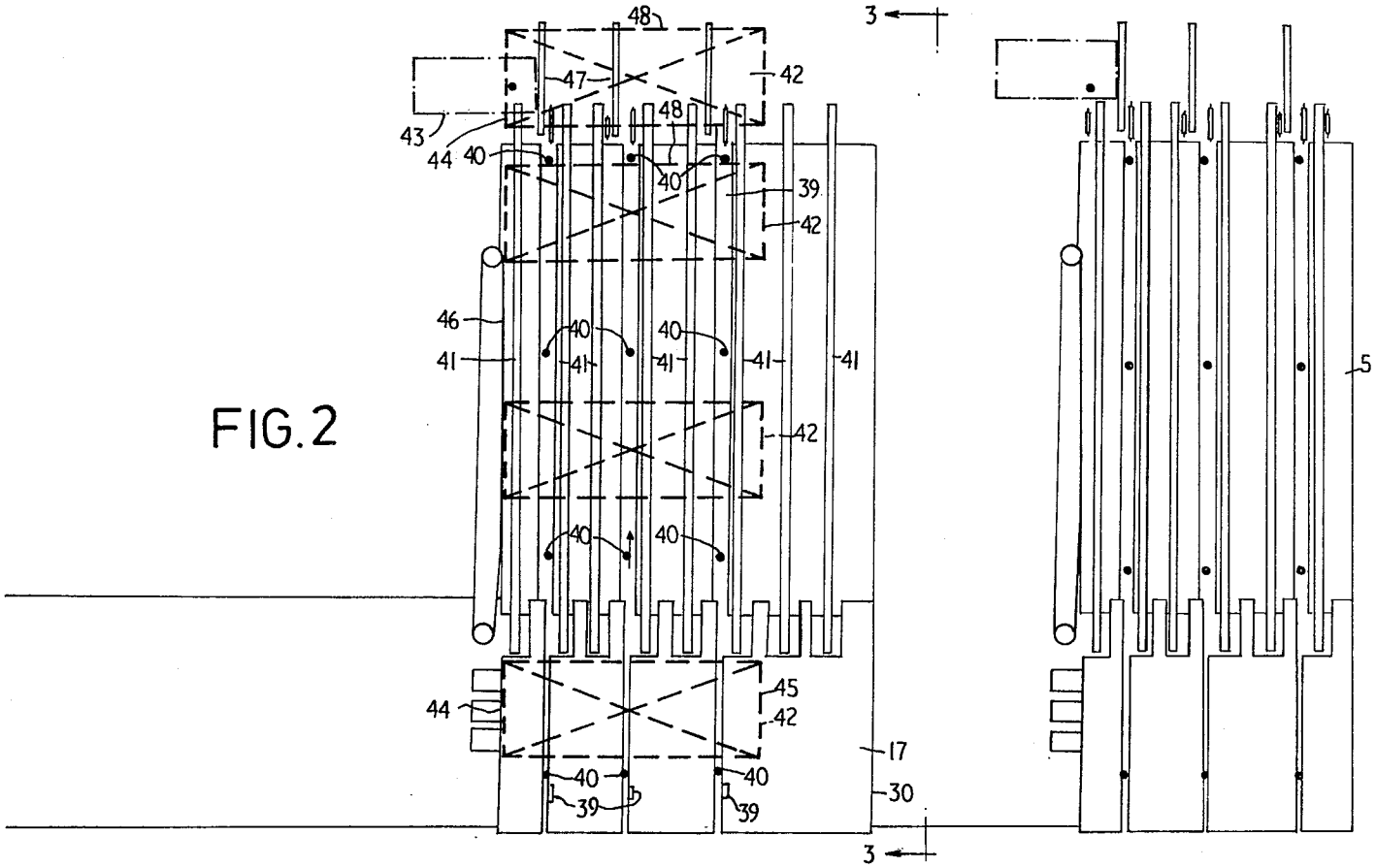
FIG. 2 is a plan view of the transfer machine illustrated in FIG. 1.

In the arrangement shown in FIG. 2 an alignment belt 46 is provided and located along one side of cross-conveyor 50 to maintain the trailing edge 44 of the tube lengths in alignment with respect to the sewing head of the sewing machine. Further belts may be provided, similar to belts 41, but arranged to act on the other side of the tube lengths as they pass over belts 41 in order to hold the tube lengths in position. These additional belts may be inclined at an angle to the longitudinal direction of belts 41 in order to bias the tube lengths 42 towards the alignment belt 46.

The sewing machine 43 has associated therewith a further series of feed rollers 49 and belts 47, the speed of which is synchronised to suit the sewing speed of the sewing head. When the tube lengths 42 arrive at the discharge end of cross-conveyor 50, driving pins 40, which are immediately in front of the tube lengths, drop down to return and thus enabling the faster feed belts 41 to deliver the tube lengths to the sewing machine feed rollers 49 and belts 47. These feed rollers 49 run in cooperation with belts 47 to grip the tube lengths and control the feed of the tube lengths through the sewing machine. To assist transfer of the tube lengths from cross-conveyor 50 into the sewing machine feed control mechanism, rollers 49 are arranged to lift off belts 47, so that the leading side 48 of each successive tube length enters between the feed roller 49 and belt 47, and subsequently the rollers lower to grip the tube length.

The conveyors, which feed the tube lengths from the cutting head 10 of the tubing machine to the sewing machine cross fed stations 17, 18, 19 and 20, and the cross feed conveyors 50 and 51 (the cross conveyors associated with stations 18 and 20 are not illustrated in FIG. 2) are coupled to the drive of the tubing machine, all machine timing being controlled with respect to the cutting head 10 or drive of the tubing machine.

If on the other hand a variable speed cutting head tubing machine having a constant speed paper feed were required, then the transfer mechanism herein described should be coupled to the tubing machine feed drive as opposed to that of the cutting head.

Figure 3:
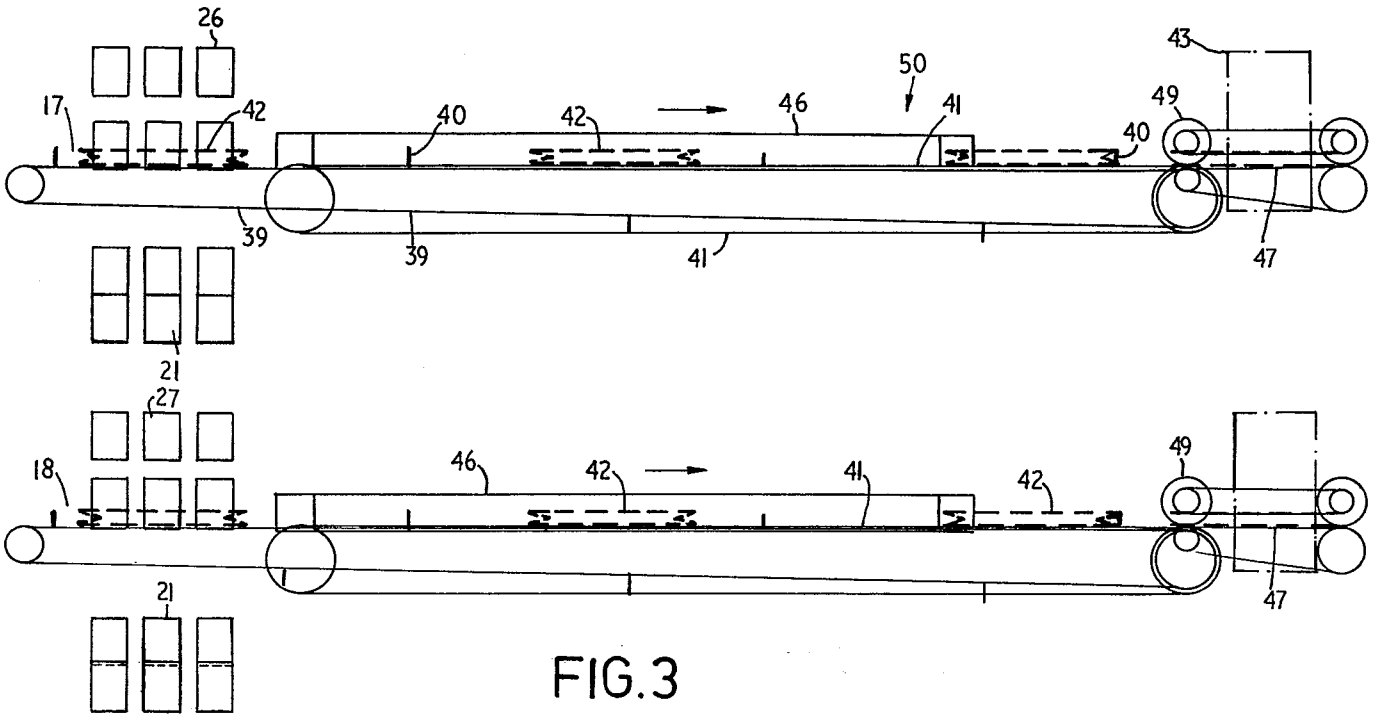
FIG. 3 is an end elevation along line 3—3 in FIG. 2.

In the embodiment illustrated the sewing machines and their associated feed control mechanisms are also coupled and controlled with respect to the tubing machine drive. In the normal operation of a sewing machine one revolution of the sewing machine drive mechanism produces one stitch and as the length of the stitches generally remain constant a narrow width tube requires less stitches and therefore less revolutions than a wider width tube. In order to allow adjustment of sewing machine speed to suit varying widths of tube a variable speed drive is provided between the tubing machine and sewing machine drives. Accordingly, to handle various tube lengths, it is only necessary to adjust end stops 34, 35, 36 and 37 and in order to handle different widths of sack it is only necessary to adjust the variable speed unit that drives the sewing machines. In the arrangement illustrated in FIGS. 1 to 3 or 4 the sewing machines are required to travel slower in relationship to the speed of the cross feed conveyors during a run of narrow width tubes as opposed to a run having wider tubes. It should be noted that the pitch between adjacent driving pins 40 is determined by the maximum width of tube produced by the tubing machine, and the relative speeds of feed control belts 47 and driving chains 39 are selected to provide substantially uninterrupted operation of the sewing machines. The relative speed of the drive chains 39 is such that the drive pins 40 travel one pitch for every two revolutions of cutting head 10. In two revolutions of the cutting head four tubes are produced and there are four cross-feed conveyor sewing units in the arrangement described in FIGS. 1 to 3, the additional sewing machine feed stations 63 and 64 as shown in FIG. 4 being only spare stations. Should a greater or lesser number of sewing heads be required for continuous use then the time cycle would be adjusted accordingly. Further, the sewing machines may be controlled by a triggering device which engages a clutch when the tube lengths are present at or adjacent the sewing head for sewing. Here it should be noted that reinforcement tape is normally sewn across and along the tube length end to be sealed when the sewing method of sealing is used. The tape is fed to the sewing machine from a convenient supply located adjacent the sewing head. Further during sewing, adjacent and successive bags are spaced apart to provide a nominal gap therebetween, the tape being continuous and extending from the sealed end of one bag to the adjacent bag. As the sewing head is normally operated continuously, the stitching continues into the tape in the gap between bags. Accordingly when the portion of the tape and stitching in the gap is cut to separate the bags, the additional stitching in that portion of the tape tends to prevent the stitching at the sealed end from becoming undone.

In the event of an interruption in the flow of tube lengths to the sewing machine it is desirable that the abovementioned triggering device, which operates a clutch to engage and disengage the sewing machine drive, stops the sewing machine with a tube length being sewn in a suitable position so that when the tube lengths are again received at the sewing machine it will restart to maintain the desired gap between bags.

It will be appreciated by those skilled in the art that the transfer machine disclosed above is equally applicable for coupling to sewing machines, tubing machines of other known types having any suitable number of cutting edges, the above type of tubing machine being described as an exemplary embodiment only. Alternatively the transfer machine of the present invention may be adapted to couple tubing machines of other known types to other forms of bottoming or sealing machines, for example, machines for sealing a stepped end type multi-walled sack. Further, it will be appreciated that any number of sewing machines and their associated feeding stations may be coupled to receive tube lengths from a tubing machine. Also by suitable operation of gates 12, 15, 16, 22 and 23 it is possible to feed the tube lengths to the sewing machine feeding stations in any required sequence and accordingly the transfer machine may be arranged in any suitable configuration as required.

What I claim is:

1. A bag making machine comprising a tubing machine having means for forming a tube of suitable material, and means for cutting the formed tube into tube-lengths and axially discharging the tube-lengths therefrom, each said tube-length being spaced apart during discharge from said tubing machine, a first tube-end sealing machine, a second tube-end sealing machine, a transfer machine adapted to receive a flow of spaced and axially disposed tube-lengths formed by said tubing machine and to transfer said tube-lengths to said tube-end sealing machines in spaced relationship to each other, said transfer machine comprising: a first feed conveyor feeding said first tube-end sealing machine, a second feed conveyor feeding said second tube-end sealing machine, each said feed conveyor having a receiving end and a discharge end, first flow directing means for directing tube-lengths selected by said first flow directing means from said flow of spaced tube-lengths received at an input to said transfer machine in a cyclic predetermined sequence to said receiving end of said first feed conveyor, second flow directing means, said first flow directing means operable to direct the remaining tube-lengths of said flow to said second flow directing means by-passing said first feed conveyor, said second flow directing means operable to direct tube-lengths received at said second flow directing means to said receiving end of said second feed conveyor or to a discharge.

2. A bag making machine as claimed in claim 1, wherein each said feed conveyor is aligned transversely of the direction of motion of said flow of spaced tube-lengths directed thereto, whereby, the tube-lengths are axially disposed upon receipt at said feed conveyor and are thereafter fed by said feed conveyor sideways to said tube-end sealing machines.

3. A bag making machine as claimed in claim 2, wherein each said flow directing means is a two-way gate.

4. A transfer machine comprising: a receiving station for receiving a succession of tube-lengths axially discharged from a tubing machine, a plurality of feed conveyors, each said feed conveyors having a receiving end and a discharge end, and means for directing and axially feeding successive tube-lengths in a cyclic predetermined sequence from said receiving station to said receiving ends of said feed conveyors, each said feed conveyor being aligned transversely of the direction of motion of said successive tube-lengths directed and axially fed thereto, wherein each said feed conveyor comprises a plurality of abutment means arranged at regular predetermined intervals along the length of the conveyor and movable from said receiving end to said discharge end of said feed conveyor, whereby an adjacent one of said abutment means abuts a trailing side of each successive tube length received at said receiving end of said feed conveyor and urges the tube length towards said discharge end of said feed conveyor, and biasing means engaging each successive tube length during movement thereof to said discharge end and for causing each tube length to move forward with respect to said adjacent one of said abutment means and abut at its leading side against a forward and adjacent one of said abutment means.

5. A transfer machine as claimed in claim 4 further including a plurality of sewing machines located to receive and seal an open end of each tube length of a succession of tube lengths discharged from said feed conveyors.

6. A transfer machine as claimed in claim 4, wherein said abutment means comprises a row of pins arranged transversely of the direction of motion thereof.

7. A transfer machine as claimed in claim 4, wherein said bias means comprises an endless belt in frictional contact with said successive tube lengths, said belt moving at a speed greater than that of said abutment means.

8. A transfer machine as claimed in claim 5, wherein the sewing machines and said transfer machine are coupled to the tubing machine.

9. A transfer machine as claimed in claim 4, wherein the operation timing of the transfer machine is controlled with respect to the tubing machine.

10. A transfer machine as claimed in claim 9, wherein the transfer machine is coupled to the tubing machine, thereby controlling the operation timing of the transfer machine with respect to the tubing machine.

11. A transfer machine as claimed in claim 8, wherein the tubing machine is provided with a cutting head and said sewing machines and said transfer machine are coupled to the cutting head of the tubing machine, whereby the operation timing of said machine is controlled with respect to the cutting head speed.

12. A tube-end sealing-machine comprising a sealing head, a conveyor having a receiving end and a discharge end, the sealing head located adjacent said discharge end, a plurality of abutment means arranged at predetermined intervals along the length of the conveyor and movable from said receiving end to said discharge end, whereby, upon receipt at said receiving end of a succession of tube lengths, the tubular axis of which is in transverse alignment with respect to said conveyor, an adjacent one of said abutment means abuts a trailing edge of each successive tube length and urges the tube length towards said discharge end of the conveyor, and bias means causing each tube length to move forward with respect to said adjacent one of said abutment means and abut at its leading side against a forward and adjacent one of said abutment means.

13. A tube-end sealing-machine as claimed in claim 12, including a tubing machine, at least one further one of said tube-end sealing-machines and means directing a tube length of a succession of tube lengths cut at and axially discharged from said tubing machine in a cyclic sequence to said receiving end of said conveyor of each tube-end sealing-machine.

14. A tube-end sealing-machine as claimed in claim 12, wherein said sealing head comprises a sewing head and a sewing head feed device, which receives tube lengths discharged from said conveyor, said sewing head being positioned to seal an open end of each successive tube length passing therethroough following discharge from said conveyor, and the operation timing of the sewing head being controlled with respect to the conveyor.

15. A tube-end sealing-machine as claimed in claim 12, wherein said abutment means comprises a row of fingers arranged transversely of the direction of motion thereof.

16. A tube-end sealing-machine as claimed in claim 12, wherein the conveyor further includes a receiving platform at said receiving end for receiving tube lengths discharged thereon with their tubular axes in transverse alignment with respect to the direction of motion of said conveyor, and a stop, said stop being located at a predetermined position on and adjacent one side of the platform remote from the source of tube-lengths discharged thereon, thereby, upon receipt of each tube length of a succession of tube lengths having a leading open end which abuts against said stop, and a trailing open end, said trailing open end of each tube-length is located in a predetermined position with respect to a longitudinal side of said conveyor, and following receipt of each tube length at said platform, the tube length is urged by said abutment means from said platform towards said discharge end.

17. A tube-end sealing-machine as claimed in claim 16, wherein said stop means is adjustable towards or away from said source of tube-lengths to suit different lengths of said tube lengths.

18. A tube-end sealing-machine as claimed in claim 16, wherein said bias means comprises an endless belt in frictional contact with said successive tube lengths, said belt moving at a speed greater than that of said abutment means.

19. A tube-end sealing-machine as claimed in claim 16, wherein said sealing head is located adjacent said longitudinal side of said conveyor, said longitudinal side of said conveyor being substantially co-extensive with another side of said platform remote from said stop.

20. A tube-end sealing-machine as claimed in claim 13, wherein the operation timing of said sealing heads and their respective conveyors and said means directing tube lengths is controlled with respect to the tubing machine.

21. A bag making machine comprising:

a tubing machine having means for forming a tube of suitable material, and means for cutting the formed tube into tube-lengths and axially discharging the tube-lengths therefrom;

a plurality of tube-end sealing machines; and a transfer machine adapted to receive a succession of spaced tube-lengths axially discharged from said tubing machine and to transfer said tube-lengths to said plurality of tube-end sealing machines in spaced relationship to each other, said transfer machine comprising:

a plurality of feed conveyors, each said feed conveyor feeding a respective one of said plurality of tube-end sealing meachines, each said feed conveyor having a receiving end and a discharge end, means for directing and axially feeding successive tube-lengths of said succession of tube-lengths in spaced relationship to each other in a cyclic predetermined sequence from said tubing machine to said receiving ends of said feed conveyors, each said feed conveyor being aligned transversely of the direction of motion of said successive tube-lengths directed and axially fed thereto by said directing and feeding means, whereby, upon receipt of tube-lengths each having a leading and a trailing open end at discharge from said tubing machine, the tube-lengths are transferred sideways to provide a leading and trailing closed side edge during feeding thereof to said tube-end sealing machines, and bypass means associated with said tube-end sealing machines and adapted to transfer tube-lengths received thereby past a selected tube-end sealing machine, said directing and feeding means being operable to prevent receipt of tube-lengths at said selected tube-end sealing machine and to direct those tube-lengths to the bypass means.

22. A bag making machine as claimed in 21, wherein said directing and feeding means comprises a plurality of directional gates and associated tube-length conveyors, said gates being operable to direct the tube-lengths in said cyclic sequence to said receiving ends of said feed conveyors.

23. A bag making machine as claimed in claim 22, wherein the operation timing of the transfer machine is controlled with respect to the operation timing of the tubing machine.

24. A bag making machine as claimed in claim 23, wherein the transfer machine drive is coupled to the tubing machine drive, thereby controlling the operation timing of the transfer machine with respect to the tubing machine.

25. A bag making machine as claimed in claim 24, wherein the drives of said tube-end sealing machines are coupled to the transfer machine drive; and further including decoupling means in each tube-end sealing machine drive, thereby permitting shut-down of said selected tube-end sealing machine upon tube-lengths being directed to the associated bypass means of said selected tube-end sealing machine.

26. A bag making machine as claimed in claim 23, wherein each said tube-end sealing machine is a sewing machine.

27. A bag making machine as claimed in claim 26, wherein the sewing machine drives and the transfer machine drive are coupled to the tubing machine drive.

28. A bag making machine as claimed in claim 26, wherein each said sewing machine comprises a sewing head and a sewing head feed device, which receives tube-lengths discharged from said feed conveyor, said sewing head being positioned to seal an open end of each successive tube-length passing therethrough following discharge from said feed conveyor, and the operation timing of the sewing head being controlled with respect to said feed conveyor.

29. A bag making machine as claimed in claim 21, wherein each said feed conveyor comprises a plurality of abutments arranged at regular predetermined intervals along the length of the conveyor and movable from said receiving end to said discharge end of the conveyor, whereby an adjacent one of said abutments abuts a trailing side of each successive tube-length received at said receiving end of said feed conveyor and urges the tube-length towards said discharge end of said feed conveyor, and biasing means for engaging each successive tube-length during movement thereof to said discharge end and for causing each tube-length to move forward with respect to said adjacent one of said abutments and abut at its leading side against a forward and adjacent one of said abutments.

30. A bag making machine as claimed in claim 29, wherein each one of said abutments comprises a row of pins arranged transversely of the direction of motion thereof.

31. A bag making machine as claimed in claim 29, wherein said biasing means comprises a travelling belt in frictional contact with said successive tube-lengths, said belt moving at a speed greater than that of said abutments.

32. A bag making machine as claimed in claim 29, wherein said feed conveyor further includes a receiving platform at said receiving end for receiving tube-lengths discharged thereon with their tubular axes in transverse alignment with respect to the direction of motion of said feed conveyor, and a stop, said stop being located at a predetermined position on and adjacent one side of the platform remote from the source of tube-lengths discharged thereon, thereby, upon receipt of each tube-length of a succession of tube-lengths having a leading open end which abuts against said stop and a trailing open end, said trailing open end of each tube-length is located in a predetermined position with respect to a longitudinal side of said feed conveyor, and following receipt of each tube-length is urged by one of said abutments from said platform towards said discharge end.

33. A bag making machine as claimed in claim 31, further including a sealing head located adjacent said discharge end of each said feed conveyor and adjacent said longitudinal side of said feed conveyor, said longitudinal side of said feed conveyor being substantially co-extensive with another side of said platform remote from said stop.

34. A bag making machine as claimed in claim 32, wherein said stop is adjustable towards or away from said source of tube-lengths to suit different lengths of said tube-lengths.

35. A bag making machine as claimed in claim 27, wherein the tubing machine is provided with a substantially constant speed cutting head and said sewing machines and said transfer machine are coupled to the cutting head of the tubing machine, whereby the operation timing of said machines is controlled with respect to the cutting head speed.

* * * * *